US011399563B2

(12) United States Patent
Lang

(10) Patent No.: US 11,399,563 B2
(45) Date of Patent: Aug. 2, 2022

(54) AEROSOL-GENERATING ARTICLE HAVING NOVEL TOBACCO SUBSTRATE

(71) Applicant: Philip Morris Products S.A., Neuchatel (CH)

(72) Inventor: Gerhard Lang, Murten (CH)

(73) Assignee: Philip Morris Products S.A., Neuchatel (CH)

( * ) Notice: Subject to any disclaimer, the term of this patent is extended or adjusted under 35 U.S.C. 154(b) by 365 days.

(21) Appl. No.: 16/321,932

(22) PCT Filed: Aug. 10, 2017

(86) PCT No.: PCT/EP2017/070378
§ 371 (c)(1),
(2) Date: Jan. 30, 2019

(87) PCT Pub. No.: WO2018/033476
PCT Pub. Date: Feb. 22, 2018

(65) Prior Publication Data

US 2019/0166904 A1 Jun. 6, 2019

(30) Foreign Application Priority Data

Aug. 17, 2016 (EP) ..... 16184585

(51) Int. Cl.
*A24B 15/28* (2006.01)
*A24B 15/12* (2006.01)
(Continued)

(52) U.S. Cl.
CPC ..... *A24B 15/287* (2013.01); *A24B 15/12* (2013.01); *A24B 15/16* (2013.01); *A24D 1/20* (2020.01)

(58) Field of Classification Search
CPC ..... A24D 1/02; A24D 1/20; A24B 15/287
See application file for complete search history.

(56) References Cited

U.S. PATENT DOCUMENTS 3,720,214 A 3/1973 Norman et al.
3,802,441 A 4/1974 Hammersmith
(Continued)

FOREIGN PATENT DOCUMENTS

CN 101596015 A 12/2009
CN 101785577 A 7/2010
(Continued)

OTHER PUBLICATIONS

Decision to Grant dated Oct. 28, 2020 in corresponding Russian Patent Application No. 2019104305/12(008149), (with English Translation), 17 pages.
(Continued)

*Primary Examiner* — Eric Yaary
(74) *Attorney, Agent, or Firm* — Oblon, McClelland, Maier & Neustadt, L.L.P.

(57) ABSTRACT

A heated aerosol-generating article is provided, including an aerosol-forming substrate including tobacco and a metal-based sulphide scavenger compound, an amount of a metal component of the sulphide scavenger compound in the aerosol-forming substrate is at least 0.05 percent by weight, based on a total dry weight of the aerosol-forming substrate, and the sulphide scavenger compound is based on a transition metal.

5 Claims, 2 Drawing Sheets

(51) Int. Cl.
*A24B 15/16* (2020.01)
*A24D 1/20* (2020.01)

(56) References Cited

U.S. PATENT DOCUMENTS

| | | | | |
|---|---|---|---|---|
| 3,807,416 | A | 4/1974 | Hedge et al. | |
| 4,015,610 | A | 4/1977 | Pasche | |
| 4,055,191 | A * | 10/1977 | Norman | A24B 15/246 131/334 |
| 4,981,522 | A | 1/1991 | Nichols. et al. | |
| 5,065,776 | A | 11/1991 | Lawson | |
| 2003/0131859 | A1* | 7/2003 | Li | A24B 15/28 131/364 |
| 2007/0137666 | A1 | 6/2007 | Xue et al. | |
| 2011/0203599 | A1* | 8/2011 | Inoue | A24B 15/28 131/284 |
| 2011/0271970 | A1 | 11/2011 | Uwano et al. | |
| 2012/0024303 | A1* | 2/2012 | Sugai | A24B 15/30 131/290 |
| 2012/0006340 | A1 | 6/2012 | Xue et al. | |
| 2014/0041674 | A1 | 2/2014 | Xue et al. | |
| 2015/0320109 | A1* | 11/2015 | Sant'Angelo | A24D 1/02 131/280 |
| 2016/0205996 | A1* | 7/2016 | John | A24D 1/02 |

FOREIGN PATENT DOCUMENTS

| | | | |
|---|---|---|---|
| CN | 102429318 | A | 5/2012 |
| CN | 102658002 | A | 9/2012 |
| EA | 023357 | B1 | 5/2016 |
| EP | 2 130 444 | A1 | 12/2009 |
| JP | S53-006240 | B | 3/1978 |
| JP | S64-047445 | A | 2/1989 |
| JP | H09-047500 | A | 2/1997 |
| JP | 2011/517574 | A | 6/2011 |
| JP | 2019-528054 | A | 10/2019 |
| RU | 2 248 737 | C2 | 3/2005 |
| WO | 2010/084792 | A1 | 7/2010 |
| WO | WO 2013/098405 | A2 | 7/2013 |
| WO | WO 2013/190036 | A1 | 12/2013 |
| WO | WO 2015/075650 | A1 | 5/2015 |
| WO | WO 2016/050471 | A1 | 4/2016 |
| WO | WO 2016/120177 | A1 | 8/2018 |

OTHER PUBLICATIONS

International Search Report and Written Opinion dated Oct. 20, 2017 in PCT/EP2017/070378 filed Aug. 10, 2017.

Combined Chinese Office Action and Search Report dated Apr. 6, 2021 in Chinese Fatem Application No. 201780047347.3 (with English translation). 21 pages.

"Synthetic Ammonia Purification", Department of Personnel Education, Ministry of Chemical Industry, Education and Training Center Organization of the Ministry of Chemical Industry, Chemical Industry Press, Aug. 31, 1997, pp. 20-21 with cover pages.

Japanese Office Action dated Aug. 23, 2021 in corresponding Japanese Patent Application No. 2019-508938 (with English translation), 6 pages.

Chinese Office Action and Search Report dated Nov. 17, 2021 in corresponding Chinese Patent Application No. 201780047347.3 (with English translation), 17 pages.

Jin Wenbo, et al. "Tobacco Chemistry", Tsignhua University Press, Sep. 30, 1994, 3 pages.

Office Action dated Feb. 7, 2022 in corresponding Japanese Patent Application No. 2019-508938 (with English Translation), 5 pages.

Combined Chinese Office Action and Search Report dated Mar. 3, 2022 in Chinese Patent Application No. 201780047347.3 (with English translation) 16 pages.

Li Qiye, et al. "Textile Commodity Science" China Materials Publishing House, Nov. 30, 2005, p. 161 and cover pages.

* cited by examiner

AEROSOL-GENERATING ARTICLE HAVING NOVEL TOBACCO SUBSTRATE

The present invention relates to an aerosol-generating article incorporating a novel tobacco substrate and to an aerosol-generating device including such an aerosol-generating article.

A number of smoking articles in which tobacco is heated rather than combusted have been proposed in the art. One aim of such heated smoking articles is to reduce known harmful smoke constituents of the type produced by the combustion and pyrolytic degradation of tobacco in conventional cigarettes.

Typically in such heated smoking articles, an aerosol is generated by the transfer of heat from a heat source to a physically separate aerosol-forming substrate or material, which may be located within, around or downstream of the heat source. During smoking, volatile compounds are released from the aerosol-forming substrate by heat transfer from the heat source and entrained in air drawn through the smoking article. As the released compounds cool, they condense to form an aerosol that is inhaled by the user.

A number of prior art documents disclose aerosol-generating devices for consuming or smoking heated smoking articles. Such devices include, for example, electrically heated aerosol-generating devices in which an aerosol is generated by the transfer of heat from one or more electrical heating elements of the aerosol-generating device to the aerosol-forming substrate of a heated smoking article. One advantage of such electrical smoking systems is that they significantly reduce sidestream smoke, while permitting a user to selectively suspend and reinitiate smoking.

During the use of electrically heated aerosol-generating devices, the power supplied to the heating element is controlled in order to achieve a specific heating profile that provides a substantially consistent aerosol delivery to the consumer over time. During a first phase of the heating profile, referred to herein as the "pre-heating phase", power is provided to the heating element to raise it to from the ambient temperature to a first temperature, at which aerosol is generated from the aerosol-forming substrate. In many devices, it is desirable to generate aerosol with the desired constituents as soon as possible after activation of the device, since consumers do not want to have to wait for a significant period following activation of the device before having a first puff. For this reason, in the first phase, power may be supplied to the heating element to raise it to the first temperature as quickly as possible. Following the pre-heating phase, the heating profile shifts to a second heating phase in which power is supplied to the heating element to retain it at a second temperature, typically lower than the first temperature, to achieve a consistent delivery of aerosol to the consumer as the consumer puffs on the aerosol-generating article.

It has been found that during the pre-heating phase, certain compounds are released from the aerosol-forming substrate as it heats up, which produce an undesirable malodour that may be detected by the consumer. One of the main compounds causing this malodour has been identified as hydrogen sulphide, which has an unpleasant *sulphurous* odour. Other compounds such as methanethiol and carbonyl sulphide may also contribute to the malodour, although typically to a lesser extent.

It would be desirable to provide an aerosol-generating article with novel means for reducing malodour during the pre-heating phase. It would be particularly desirable to provide an aerosol-generating article having means for reducing malodour that can be incorporated without significant modification of the construction of the aerosol-generating article. It would further be desirable to provide such means for reducing malodour that can be incorporated with minimal impact on the smoking experience for the consumer.

According to a first aspect of the invention there is provided an aerosol-generating article comprising: an aerosol-forming substrate comprising tobacco and a metal-based sulphide scavenger compound. The amount of the metal component of the sulphide scavenger compound in the aerosol-forming substrate is at least 0.05 percent by weight, based on the total dry weight of the aerosol-forming substrate.

According to a second aspect of the invention there is provided an aerosol-generating system comprising: an aerosol-generating device comprising a heating element; and an aerosol-generating article for use with the aerosol-generating device, the aerosol-generating article comprising: an aerosol-forming substrate comprising tobacco and a metal-based sulphide scavenger compound. The amount of the metal component of the sulphide scavenger compound in the aerosol-forming substrate is at least 0.05 percent by weight, based on the total dry weight of the aerosol-forming substrate.

According to a third aspect of the invention there is provided an aerosol-forming substrate for an aerosol-generating article, the aerosol-forming substrate comprising tobacco and a metal-based sulphide scavenger compound. The amount of the metal component of the sulphide scavenger compound in the aerosol-forming substrate is at least 0.05 percent by weight, based on the total dry weight of the aerosol-forming substrate.

According to a fourth aspect of the invention there is provided a use of a sulphide scavenger compound based on a transition metal in the aerosol-forming substrate of a heated aerosol-generating article to reduce the level of hydrogen sulphide released during heating of the aerosol-generating article.

Features described below in relation to one aspect or embodiment of the invention may also be applicable to other aspects and embodiments. For example, features described in relation to the aerosol-forming substrate of aerosol-generating articles according to the invention will typically also be applicable to the aerosol-forming substrate of the aerosol-generating articles of aerosol-generating systems according to the invention and to aerosol-forming substrates according to the invention.

As used herein, the term "heated aerosol-generating article" refers to a heat-not-burn article comprising an aerosol-forming substrate that, when heated, releases volatile compounds that can form an aerosol. The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

As used herein, the term "aerosol-generating device" refers to a device that interacts with an aerosol-forming substrate of an aerosol-generating article to generate an aerosol.

As used herein, the terms "upstream" and "downstream" are used to describe the relative positions of elements, or portions of elements, of the aerosol-generating article in relation to the direction in which a user draws on the aerosol-generating article during use thereof.

As used herein, the term "sulphide scavenger compound" refers to a compound that has the potential to chemically react with sulphide compounds such as hydrogen sulphide to convert them into a less volatile form. Certain sulphide scavenger compounds may additionally act to reduce other sulphur compounds, including for example mercaptans, such as methanethiol.

Aerosol-generating articles according to the present invention incorporate a sulphide scavenger compound in the aerosol-forming substrate which acts to remove at least a proportion of the hydrogen sulphide released from the aerosol-forming substrate during the pre-heating phase described above. The hydrogen sulphide is thereby prevented from reaching the consumer such that the malodour during pre-heating can be effectively reduced or eliminated.

By providing the sulphide scavenger compound in the aerosol-forming substrate together with the tobacco material, the sulphide scavenger compound is advantageously positioned to come into contact with the sulphide compounds that are released from the aerosol-forming substrate during pre-heating.

The sulphide scavenger compound can advantageously be combined with the tobacco material forming the aerosol-forming substrate prior to the assembly of the aerosol-generating article so that the construction and manufacture of the aerosol-generating article are substantially unaffected.

As defined above, the aerosol-forming substrate of aerosol-generating articles according to the invention incorporates a sulphide scavenger compound that is metal-based. This means that the compound comprises a metal as one of the main constituents. Preferably, the wrapper comprises a sulphide scavenger compound selected from the group consisting of: a metal salt, a metal complex, a metal oxide, or combinations thereof.

Preferably, the sulphide scavenger compound is based on a transition metal. The term "transition metal" is used herein to refer to a metal in the d-block of the Periodic table. Preferably, the transition metal is selected from the group consisting of zinc, iron and copper. In particularly preferred embodiments, the sulphide scavenger compound is based on zinc.

In embodiments in which the sulphide scavenger compound is a metal salt, any suitable salt may be used, which can be selected by the skilled person depending on the metal. For example, the metal salt may be a carbonate, chloride, sulphate, hydroxide, nitrate, malate, acetate, citrate or bromide.

In embodiments in which the sulphide scavenger compound is a metal complex, any suitable complex may be used, which can be selected by the skilled person depending on the metal. For example, the metal complex may be a chelate complex such as a complex with ethylenediaminetetraacetic acid (EDTA) or its conjugate bases.

Suitable zinc based sulphide scavenger compounds include but are not limited to: zinc carbonate, basic zinc carbonate, zinc chloride, zinc sulphate, zinc chelate such as zinc EDTA and zinc bromide.

Suitable iron based sulphide scavenger compounds include but are not limited to: iron sulphate.

Suitable copper based sulphide scavenger compounds include but are not limited to: cupric carbonate, cupric sulphate, cupric nitrate, cupric chloride and copper complexes of chlorophyls or chlorophyllins.

Suitable tin based scavenger compounds include but are not limited to: stannous fluoride, stannous chloride and stannous bromide.

According to the invention, the aerosol-forming substrate incorporates at least 0.05 percent by weight of the metal component of the sulphide scavenger compound. Preferably, the aerosol-forming substrate incorporates at least about 0.1 percent by weight of the metal component of the sulphide scavenger compound, more preferably at least about 0.2 percent by weight, more preferably at least about 0.25 percent by weight, based on the total dry weight of the aerosol-forming substrate. This effectively corresponds to the "concentration" by weight of the metal component in the aerosol-forming substrate. Alternatively or in addition, the aerosol-forming substrate preferably incorporates no more than about 5 percent by weight of the metal component of the sulphide scavenger compound, more preferably no more than about 3 percent by weight, most preferably no more than about 2.5 percent by weight, based on the total dry weight of the aerosol-forming substrate. Preferably the aerosol-forming substrate incorporates between about 0.05 percent and about 5 percent by weight of the metal component of the sulphide scavenger compound, preferably between about 0.01 and about 5 percent by weight, more preferably between about 0.2 percent and about 3 percent by weight, more preferably between about 0.25 percent and about 2.5 percent by weight, based on the total dry weight of the aerosol-forming substrate.

The aerosol-forming substrate of a single aerosol-generating article according to the invention preferably incorporates a total amount of the metal component of the sulphide scavenger compound of between about 0.1 milligrams and about 15 milligrams, more preferably between about 0.5 milligrams and about 8 milligrams. These values are based on an aerosol-forming substrate having a dry weight of approximately 275 milligrams.

Preferably, the sulphide scavenger compound is incorporated in a sufficient amount to achieve a reduction of at least 30 percent by weight of hydrogen sulphide during a pre-heating test compared with an equivalent aerosol-generating article without the sulphide scavenger compound in the aerosol-forming substrate, more preferably at least 50 percent, most preferably at least 70 percent. For the purposes of such a comparison, both the aerosol-generating article with and without the sulphide scavenger compound in the aerosol-forming substrate are pre-heated in a pre-heating test as defined below.

In the pre-heating test, an aerosol-generating article is inserted into an aerosol-generating device comprising a heating element for heating the aerosol-forming substrate of the aerosol-generating article. The heating element is programmed to heat at 350 degrees Celsius for 30 seconds and then switch off, to simulate the pre-heating phase of the aerosol-generating article during normal use. During the heating of the aerosol-generating article, the aerosol-generating article is placed in a sealed glass vial so that the gas phase constituents released from the aerosol-generating article during heating are collected. A sample of the gas phase constituents collected within the vial is then removed and the concentration of hydrogen sulphide is determined using a liquid chromatography-mass spectrometry method. A suitable aerosol-generating device for the pre-heating test is the iQOS® heat-not-burn device from Philip Morris International, which is commercially available.

Preferably, the sulphide scavenger compound has a minimal impact on the delivery of nicotine from the aerosol-forming substrate to the user.

The sulphide scavenger compound may be incorporated into the aerosol-forming substrate in a variety of different ways. For example, the sulphide scavenger compound may be sprayed, sprinkled, dusted, or otherwise applied to an aerosol-forming substrate that has already been formed from a tobacco material. Alternatively, the sulphide scavenger may be blended with one or more components used to make the aerosol-forming substrate or a portion of the aerosol-forming substrate, prior to the formation of the aerosol-forming substrate. In certain embodiments, the sulphide scavenger compound may be dissolved in or suspended in a liquid composition used to make the aerosol-forming substrate or a portion of the aerosol-forming substrate.

The aerosol-forming substrate of aerosol-generating articles according to the invention comprises tobacco. Preferably, the aerosol-forming substrate is a solid aerosol-forming substrate. The aerosol-forming substrate may comprise both solid and liquid components.

The aerosol-forming substrate may further comprise an aerosol former. Examples of suitable aerosol formers include, but are not limited to, glycerin and propylene glycol. The aerosol-forming substrate preferably has an aerosol former content of between about 5 percent and about 30 percent by weight, based on the total dry weight of the aerosol-forming substrate. In one preferred embodiment, the aerosol-forming substrate has an aerosol former content of about 20 percent by weight, based on the total dry weight of the aerosol-forming substrate.

If the aerosol-forming substrate is a solid substrate, the solid substrate may comprise, for example, one or more of: powder, granules, pellets, shreds, strands, strips or sheets. The solid substrate may contain one or more of: herb leaf, tobacco leaf, tobacco ribs, expanded tobacco and homogenised tobacco.

The solid aerosol-forming substrate may be in the form of a plug comprising an aerosol-generating material circumscribed by a paper or other wrapper.

Optionally, the solid aerosol-forming substrate may contain tobacco or non-tobacco volatile flavor compounds, which are released upon heating of the solid aerosol-forming substrate. The solid aerosol-forming substrate may also contain capsules that, for example, include additional tobacco or non-tobacco volatile flavor compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, strands, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavor delivery during use.

Preferably, the aerosol-forming substrate comprises homogenised tobacco material. As used herein, the term "homogenised tobacco material" denotes a material formed by agglomerating particulate tobacco.

The aerosol-forming substrate may comprise a gathered sheet of homogenised tobacco material. As used herein, the term "sheet" denotes a laminar element having a width and length substantially greater than the thickness thereof. As used herein, the term "gathered" denotes a sheet that is convoluted, folded, or otherwise compressed or constricted substantially transversely to the longitudinal axis of the smoking article. The sheet of homogenised tobacco material may be crimped. As used herein, the term "crimped" denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article.

Preferably, the aerosol-forming substrate of aerosol-generating article according to the invention is produced by incorporating the sulphide scavenger compound into a homogenised tobacco slurry during the production process, as described below with reference to the methods of the present invention.

An aerosol-forming substrate comprising a sulphide scavenger compound in accordance with the present invention may have any suitable size or shape. Preferably, the aerosol-forming substrate is substantially elongate. For example, the aerosol-forming substrate may be substantially cylindrical in shape.

The aerosol-forming substrate may have a length of from about 7 mm to about 15 mm. Preferably, the aerosol-forming substrate has a length of about 10 mm. Alternatively, the aerosol-forming substrate may have a length of about 12 mm. As used herein, the term "length" refers to the dimension in the longitudinal direction of the aerosol-generating article.

The aerosol-forming substrate preferably has an external diameter that is approximately equal to the external diameter of the aerosol generating article containing the substrate. Preferably, the aerosol-forming substrate has an external diameter of from about 5 mm to about 12 mm. For example, the aerosol-forming substrate may have an external diameter of about 7.2 mm.

In preferred embodiments of the invention, the aerosol-generating article is adapted for use with an aerosol-generating device comprising a heating element. In such embodiments, the aerosol-forming substrate is preferably adapted to be penetrated by the heating element of an aerosol-generating device into which the aerosol-generating article is inserted during smoking. Where a front-plug is provided upstream of the aerosol-forming substrate, the front-plug may be adapted to be penetrated by the heating element.

In alternative embodiments of the invention, the aerosol-generating article may incorporate a heat source adjacent to the aerosol-forming substrate such that a separate aerosol-generating device is not required.

Aerosol-generating articles according to the invention preferably further comprise a support element located immediately downstream of the aerosol-forming substrate so that the aerosol-forming substrate and the support element abut each other in an axial direction. The support element preferably prevents downstream movement of the aerosol-forming substrate when the upstream end of the aerosol-generating article is inserted into a device requiring insertion force, such as may be required when inserting the aerosol-generating article into a device having a heating element configured to penetrate the aerosol-forming substrate.

The aerosol-forming substrate is preferably located at the upstream end of the aerosol-generating article. Alternatively, a front-plug may be incorporated upstream of the aerosol-forming substrate.

Aerosol-generating articles according to the invention may further comprise an aerosol-cooling element located downstream of the support element. As used herein, the term "aerosol-cooling element" describes an element having a large surface area and a low resistance to draw. In use, an aerosol formed by volatile compounds released from the aerosol-forming substrate passes over and is cooled by the aerosol-cooling element before being inhaled by a user. In contrast to high resistance to draw filters and other mouthpieces, aerosol-cooling elements have a low resistance to draw. Chambers and cavities within an aerosol-generating article are also not considered to be aerosol-cooling elements.

Alternatively or in addition, aerosol-generating articles according to the invention may further comprise a mouthpiece located at the downstream end of the aerosol-generating article. The mouthpiece may comprise a filter. The filter may be formed from one or more suitable filtration materials. Many such filtration materials are known in the art. In one embodiment, the mouthpiece may comprise a filter formed from cellulose acetate tow.

The aerosol-forming substrate and any other elements of the aerosol-generating article that are present may be circumscribed by an outer wrapper. The outer wrapper may be formed from any suitable material or combination of materials. In one embodiment, the outer wrapper is a cigarette paper.

Suitable aerosol-forming substrates, support elements, aerosol-cooling elements and mouthpieces are described in WO-A-2013/098405.

Aerosol-generating systems according to the present invention comprise an aerosol-generating article as described in detail above in combination with an aerosol-generating device which is adapted to receive the upstream end of the aerosol-generating article during smoking. The aerosol-generating device comprises a heating element which is adapted to heat the aerosol-forming substrate in order to generate an aerosol during use. Preferably, the heating element is adapted to penetrate the aerosol-forming substrate when the aerosol-generating article is inserted into the aerosol-generating device.

Preferably, the aerosol-generating device additionally comprise a housing, an electrical power supply connected to the heating element and a control element configured to control the supply of power from the power supply to the heating element. It is this control element which controls the heating to produce the heating profile including the preheating phase discussed above.

Suitable aerosol-generating devices for use in the aerosol-generating system of the present invention are described in WO-A-2013/098405.

The present invention further extends to a method for the production of an aerosol-generating article as described above. The method comprises the steps of: providing a tobacco particulate material; forming a slurry comprising the tobacco particulate material; incorporating a metal-based sulphide scavenger compound into the slurry of the tobacco particulate material; forming a tobacco sheet from the slurry comprising the tobacco particulate material and the metal-based sulphide scavenger compound; forming the tobacco sheet into a plug to provide an aerosol-forming substrate; and combining the aerosol-forming substrate with one or more components to form an aerosol-generating article.

Preferably, methods according to the invention produce an aerosol-forming substrate from a homogenised tobacco material, which is formed from the tobacco particulate material, as described above.

Preferably, the tobacco sheet is gathered into a plug, as described above. In certain preferred embodiments, the tobacco sheet is crimped.

Typically, the slurry is formed by combining the tobacco particulate material, the sulphide scavenger compound and any other additives with water. The sulphide scavenger compound may be combined with the tobacco particulate material prior to addition of the materials to the slurry. Alternatively, the sulphide scavenger compound may be added to the water separately from the tobacco particulate material.

Preferably, the slurry comprises between about 15 percent and about 25 percent by weight of the tobacco particulate material, more preferably around 20 percent. Preferably, the tobacco particulate material comprises a blend of tobacco powder of one or more types of tobacco. The tobacco powder may have any suitable mean powder size. For example, the tobacco powder may have a mean powder size in a range from about 0.03 mm to about 0.12 mm.

The slurry preferably further comprises cellulose fibres. The cellulose fibers may be present in any suitable amount. For example, the cellulose fibres may be present in a range from about 1 percent to about 3 percent by dry weight. The cellulose fibers may have any suitable size. For example, the cellulose fibers may have a mean size in a range from about 0.2 mm to about 4 mm.

Alternatively or in addition, the slurry preferably further comprises a binder. The binder may be present in any suitable amount. For example, the binder may be present in a range from between about 1 percent to about 5 percent by dry weight. Any suitable binder may be used. Examples of suitable binders include but are not limited to ethyl cellulose, acetyl cellulose, carboxymethyl cellulose, hydroxyethyl cellulose or other suitable cellulose derivatives, pectins, guar gum, carob bean hernel meal, agar, sodium alginate or other suitable alginates and combinations thereof.

Once the tobacco particulate material, sulphide scavenger compound and other optional components have been incorporated into the slurry, the slurry may be used to form a tobacco sheet using conventional methods and apparatus.

The invention will now be further described, by way of example only, with reference to the accompanying drawings in which.

Figure 1:
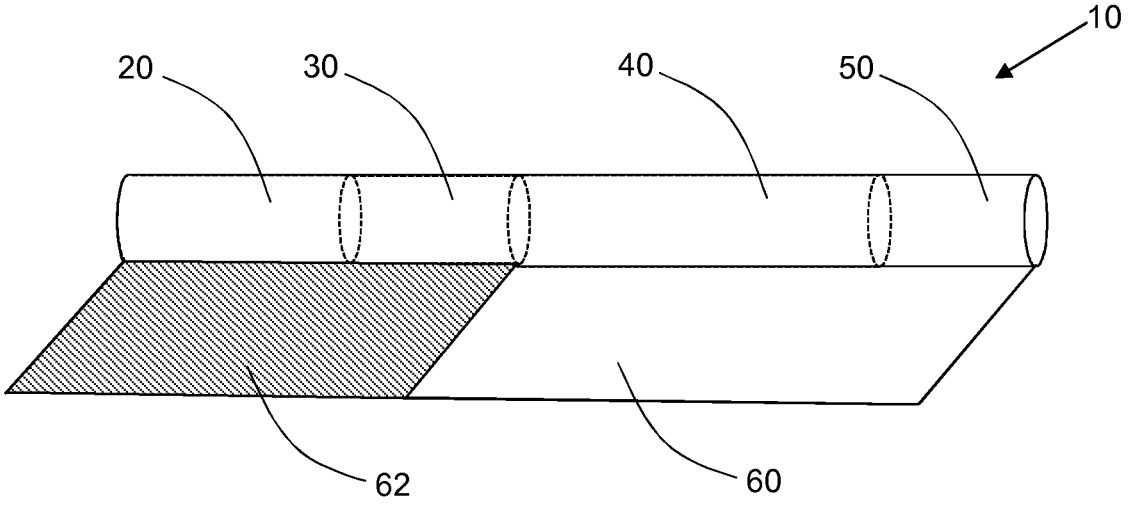
FIG. 1 is a schematic cross-sectional view of an aerosol-generating article according to an embodiment of the invention.

The aerosol-generating article 10 shown in FIG. 1 comprises four elements arranged in coaxial alignment: an aerosol-forming substrate 20, a support element 30, an aerosol-cooling element 40, and a mouthpiece 50. Each of the four elements is circumscribed by a corresponding plug wrap (not shown). These four elements are arranged sequentially and are circumscribed by an outer wrapper 60 to form the aerosol-generating article 10. The aerosol-generating 10 has a proximal or mouth end 70, which a user inserts into his or her mouth during use, and a distal end 80 located at the opposite end of the aerosol-generating article 10 to the mouth end 70.

In use air is drawn through the aerosol-generating article by a user from the distal end 80 to the mouth end 70. The distal end 80 of the aerosol-generating article may also be described as the upstream end of the aerosol-generating article 10 and the mouth end 70 of the aerosol-generating article 10 may also be described as the downstream end of the aerosol-generating article 10. Elements of the aerosol-generating article 10 located between the mouth end 70 and the distal end 80 can be described as being upstream of the mouth end 70 or, alternatively, downstream of the distal end 80.

The aerosol-forming substrate 20 is located at the extreme distal or upstream end of the aerosol-generating article 10. In the embodiment illustrated in FIG. 1, aerosol-forming substrate 20 comprises a gathered sheet of crimped homogenised tobacco material circumscribed by a wrapper. The crimped sheet of homogenised tobacco material comprises glycerin as an aerosol former. The aerosol-forming substrate 20 also comprises at least 0.05 percent by weight of a sulphide scavenger compound, based on the total dry weight of the aerosol-forming substrate 20. Suitable sulphide scavenger compounds are provided in Table 2 below.

The support element 30 is located immediately downstream of the aerosol-forming substrate 20 and abuts the aerosol-forming substrate 20. In the embodiment shown in FIG. 1, the support element is a hollow cellulose acetate tube. The support element 30 locates the aerosol-forming substrate 20 at the extreme distal end 80 of the aerosol-generating article 10 so that it can be penetrated by a heating element of an aerosol-generating device. As described further below, the support element 30 acts to prevent the aerosol-forming substrate 20 from being forced downstream within the aerosol-generating article 10 towards the aerosol-cooling element 40 when a heating element of an aerosol-generating device is inserted into the aerosol-forming substrate 20. The support element 30 also acts as a spacer to space the aerosol-cooling element 40 of the aerosol-generating article 10 from the aerosol-forming substrate 20.

The aerosol-cooling element 40 is located immediately downstream of the support element 30 and abuts the support element 30. In use, volatile substances released from the aerosol-forming substrate 20 pass along the aerosol-cooling element 40 towards the mouth end 70 of the aerosol-generating article 10. The volatile substances may cool within the aerosol-cooling element 40 to form an aerosol that is inhaled by the user. In the embodiment illustrated in FIG. 1, the aerosol-cooling element comprises a crimped and gathered sheet of polylactic acid circumscribed by a wrapper 90. The crimped and gathered sheet of polylactic acid defines a plurality of longitudinal channels that extend along the length of the aerosol-cooling element 40.

The mouthpiece 50 is located immediately downstream of the aerosol-cooling element 40 and abuts the aerosol-cooling element 40. In the embodiment illustrated in FIG. 1, the mouthpiece 50 comprises a conventional cellulose acetate tow filter of low filtration efficiency.

To assemble the aerosol-generating article 10, the four elements described above are aligned and tightly wrapped within the outer wrapper 60. In the embodiment illustrated in FIG. 1, the outer wrapper 60 is a conventional cigarette paper. As shown in FIG. 1, an optional row of perforations is provided in a region of the outer wrapper 60 circumscribing the support element 30 of the aerosol-generating article 10. A distal end portion of the outer wrapper 60 of the aerosol-generating article 10 is circumscribed by a band of tipping paper (not shown).

The aerosol-generating article 10 illustrated in FIG. 1 is designed to engage with an aerosol-generating device comprising a heating element in order to be consumed by a user. In use, the heating element of the aerosol-generating device heats the aerosol-forming substrate 20 of the aerosol-generating article 10 to a sufficient temperature to form an aerosol, which is drawn downstream through the aerosol-generating article 10 and inhaled by the user.

During the pre-heating phase, the sulphide scavenger compound in the aerosol-forming substrate acts to reduce the level of hydrogen sulphide emitted from the tobacco in the aerosol-forming substrate. In a pre-heating test as defined above, the reduction achieved is at least 30 percent compared to an aerosol-generating article of a similar construction but with a conventional aerosol-forming substrate not including the sulphide scavenger compound. For many sulphide scavenger compounds, a reduction of up to 70 percent in the level of hydrogen sulphide can be achieved. Such a reduction in the level of hydrogen sulphide means that the malodour from the hydrogen sulphide is minimised and may not be detectable by the consumer at all.

Figure 2:
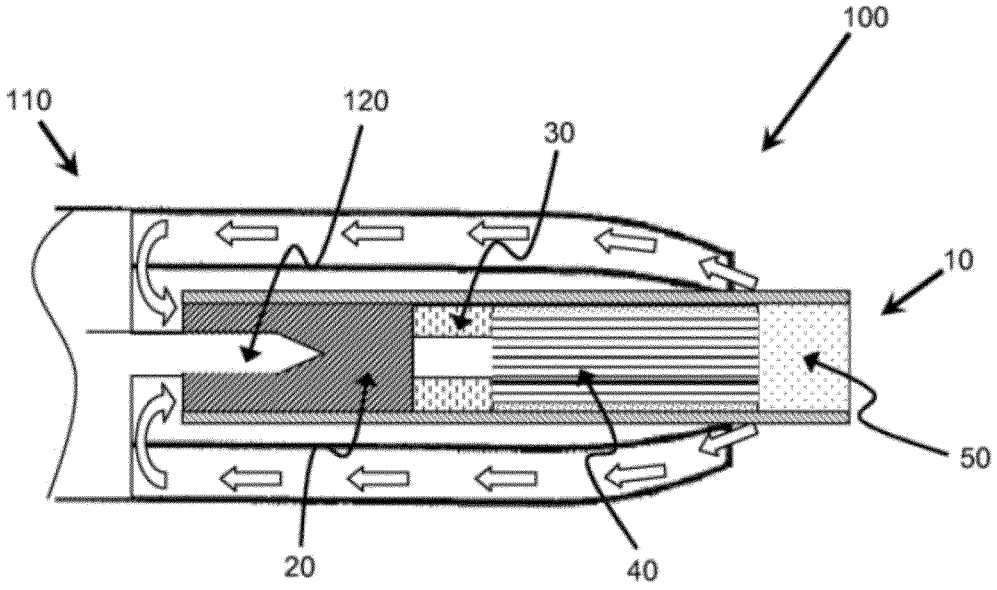
FIG. 2 is a schematic cross-sectional view of an aerosol-generating system comprising an aerosol-generating device and an aerosol generating article according to the embodiment illustrated in FIG. 1.

FIG. 2 illustrates a portion of an aerosol-generating system 100 comprising an aerosol-generating device 110 and an aerosol-generating article 10 according to the embodiment described above and illustrated in FIG. 1.

The aerosol-generating device 110 comprises a heating element 120. As shown in FIG. 2, the heating element 120 is mounted within an aerosol-generating article receiving chamber of the aerosol-generating device 110. In use, the user inserts the aerosol-generating article 10 into the aerosol-generating article receiving chamber of the aerosol-generating device 110 such that the heating element 120 is directly inserted into the aerosol-forming substrate 20 of the aerosol-generating article 10 as shown in FIG. 2. In the embodiment shown in FIG. 2, the heating element 120 of the aerosol-generating device 110 is a heater blade.

The aerosol-generating device 110 comprises a power supply and electronics (shown in FIG. 3) that allow the heating element 120 to be actuated. Such actuation may be manually operated or may occur automatically in response to a user drawing on an aerosol-generating article 10 inserted into the aerosol-generating article receiving chamber of the aerosol-generating device 110. A plurality of openings is provided in the aerosol-generating device to allow air to flow to the aerosol-generating article 10; the direction of air flow is illustrated by arrows in FIG. 2.

The support element 40 of the aerosol-generating article 10 resists the penetration force experienced by the aerosol-generating article 10 during insertion of the heating element 120 of the aerosol-generating device 110 into the aerosol-forming substrate 20. The support element 40 of the aerosol-generating article 10 thereby resists downstream movement of the aerosol-forming substrate 20 within the aerosol-generating article 10 during insertion of the heating element 120 of the aerosol-generating device 110 into the aerosol-forming substrate 20.

Once the internal heating element 120 is inserted into the aerosol-forming substrate 20 of the aerosol-generating article 10 and the heating element 120 is actuated, the aerosol-forming substrate 20 of the aerosol-generating article 10 is heated to a temperature of approximately 375 degrees Celsius by the heating element 120 of the aerosol-generating device 110. At this temperature, volatile compounds are evolved from the aerosol-forming substrate 20 of the aerosol-generating article 10. As a user draws on the mouth end 70 of the aerosol-generating article 10, the volatile compounds evolved from the aerosol-forming substrate 20 are drawn downstream through the aerosol-generating article 10 and condense to form an aerosol that is drawn through the mouthpiece 50 of the aerosol-generating article 10 into the user's mouth.

As the aerosol passes downstream thorough the aerosol-cooling element 40, the temperature of the aerosol is reduced due to transfer of thermal energy from the aerosol to the aerosol-cooling element 40. When the aerosol enters the aerosol-cooling element 40, its temperature is approximately 60 degrees Celsius. Due to cooling within the aerosol-cooling element 40, the temperature of the aerosol as it exits the aerosol-cooling element is approximately 40 degrees Celsius.

Figure 3:
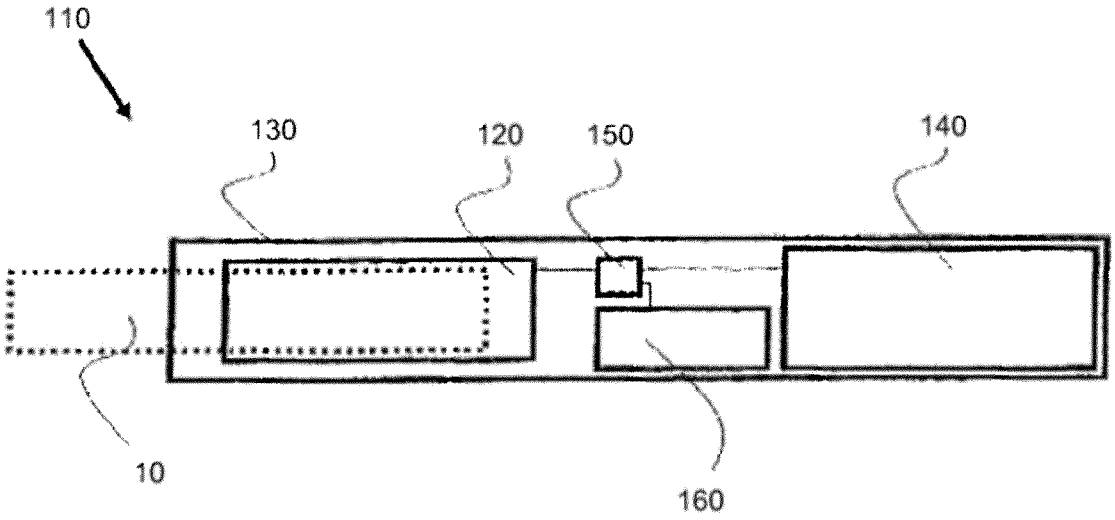
FIG. 3 is a schematic cross-sectional view of the electrically heated aerosol generating device of FIG. 2.

In FIG. 3, the components of the aerosol-generating device 110 are shown in a simplified manner. Particularly, the components of the aerosol-generating device 110 are not drawn to scale in FIG. 3. Components that are not relevant for the understanding of the embodiment have been omitted to simplify FIG. 3.

As shown in FIG. 3, the aerosol-generating device 110 comprises a housing 130. The heating element 120 is mounted within an aerosol-generating article receiving chamber within the housing 130. The aerosol-generating article 10 (shown by dashed lines in FIG. 3) is inserted into the aerosol-generating article receiving chamber within the housing 130 of the aerosol-generating device 110 such that the heating element 120 is directly inserted into the aerosol-forming substrate 20 of the aerosol-generating article 10.

Within the housing 130 there is an electrical energy supply 140, for example a rechargeable lithium ion battery. A controller 150 is connected to the heating element 120, the electrical energy supply 140, and a user interface 160, for example a button or display. The controller 150 controls the power supplied to the heating element 120 in order to regulate its temperature.

EXAMPLES

For each of the sulphide scavenger compounds indicated in Table 2 below, the sulphide scavenger compound was incorporated into a tobacco slurry having the composition shown in FIG. 1, at the concentration indicated. A tobacco sheet was formed from the tobacco slurry and the tobacco sheet was formed into an aerosol-forming substrate, using conventional techniques. An aerosol-generating article as described above with reference to FIG. 1 was then assembled. Each aerosol-generating article was subjected to the pre-heating test defined above.

The percentage reductions in hydrogen sulphide and methanethiol were measured relative to a control sample in which no sulphide scavenger compound was added to the aerosol-forming substrate.

It can be seen from the results below that for each compound, a reduction of over 50 percent of hydrogen sulphide was observed relative to the control sample. In many cases, a reduction of over 70 percent was observed. Significant reductions in methanethiol were also observed.

TABLE 1

| Slurry component | % by weight in slurry |
|---|---|
| Tobacco powder | 21 |
| Guar gum | 0.75 |
| Cellulosic fibres | 0.5 |
| Glycerin | 5 |
| Water | 72.75 |

TABLE 2

| Sulphide scavenger compound | Amount of metal component (% based on dry weight of substrate) | % Reduction in Hydrogen Sulphide | % Reduction in Methanethiol |
|---|---|---|---|
| Zinc sulphate | 1.3 | 79 | 38 |
| Zinc carbonate basic | 2.3 | 86 | 45 |
| Iron (II) sulphate | 2.0 | 63 | 48 |
| Iron (III) sulphate | 2.0 | 58 | 50 |
| Copper (II) sulphate | 0.81 | 100 | 96 |
| Copper (II) sulphate | 0.202 | 100 | 52 |
| Copper (II) sulphate | 0.051 | 89 | 40 |

The invention claimed is:

1. A heat-not-burn article, comprising:

an aerosol-forming substrate comprising a sheet of homogenised tobacco material, the homogenised tobacco material comprising tobacco, an aerosol former, and a sulphide scavenger compound based on a transition metal selected from zinc or copper, wherein an amount of a transition metal component of the sulphide scavenger compound in the aerosol-forming substrate is at least 0.05 percent by weight, based on a total dry weight of the aerosol-forming substrate, wherein the sulphide scavenger compound is a transition metal salt selected from a carbonate, sulphate, hydroxide, malate, acetate, or bromide.

2. The heat-not-burn article according to claim 1, wherein the amount of the transition metal component of the sulphide scavenger compound is between 0.05 percent and 5 percent by weight based on the total dry weight of the aerosol-forming substrate.

3. The heat-not-burn article according to claim 2, wherein the amount of the transition metal component of the sulphide scavenger compound is between 0.25 percent and 2.5 percent by weight based on the total dry weight of the aerosol-forming substrate.

4. The heat-not-burn article according to claim 1, wherein the amount of the transition metal component of the sulphide scavenger compound is at least 0.1 percent by weight based on the total dry weight of the aerosol-forming substrate.

5. The heat-not-burn article according to claim 1, wherein the sulphide scavenger compound in the aerosol-forming substrate provides a reduction of at least 50 percent by weight of hydrogen sulphide during a pre-heating test compared with an equivalent aerosol-generating article without the sulphide scavenger compound in the aerosol-forming substrate, and wherein in the pre-heating test a heating element configured to heat the aerosol-forming substrate in the heat-not-burn article is programmed to heat at 350 degrees Celsius for 30 seconds and then to switch off.

* * * * *